United States Patent [19]

Marble et al.

[11] Patent Number: 4,725,996

[45] Date of Patent: Feb. 16, 1988

[54] OPERATIONAL TIMER CIRCUIT FOR MONITORING A MOTOR UNDER LOAD

[75] Inventors: Allan E. Marble; Leslie T. Russell, both of Halifax, Canada

[73] Assignee: Bertram C. McIsaac, Halifax, Canada

[21] Appl. No.: 10,637

[22] Filed: Feb. 4, 1987

[51] Int. Cl.[4] ..... G04F 8/00

[52] U.S. Cl. ..... 368/9; 368/1

[58] Field of Search ..... 368/1, 8, 9, 5, 6

[56] References Cited

U.S. PATENT DOCUMENTS

| | | | |
|---|---|---|---|
| 3,258,908 | 7/1966 | Fischer | 368/9 |
| 3,735,081 | 5/1973 | Foerstner | 368/9 |
| 3,758,756 | 9/1973 | Johns | 368/8 |
| 3,854,281 | 12/1974 | Reichert | 368/9 |
| 3,948,039 | 4/1976 | Leveraus | 368/9 |
| 3,965,669 | 6/1976 | Larson et al. | 368/9 |
| 4,630,292 | 12/1986 | Juricich et al. | 368/8 |

*Primary Examiner*—Bernard Roskoski

*Attorney, Agent, or Firm*—Banner, Birch, McKie and Beckett

[57] ABSTRACT

The circuit comprises an elapsed time indicating meter and a silicon-controlled rectifier, used to supply power to the meter, connected in series across the circuit's first and third terminals. Additionally, the circuit includes a small resistor connected between the second and third input terminals, that is, connected in series with the a.c. device. This small resistor receives the current through the a.c. device and the voltage across the small resistor is indicative of the operational state of the a.c. device. A variable potentiometer is connected full scale across the small resistor and the variable voltage is amplified by a common-base transistor. This amplified voltage is both rectified and filtered, serving as the SCR's gate terminal input for triggering the SCR.

The potentiometer is adjustable to allow the SCR to trigger in either one of two conditions. The potentiometer can be adjusted so that the SCR triggers at all times during which the motor is turned on, or the potentiometer can be adjusted so that the SCR turns on only when the device, such as a motor, is operated under load. The latter condition allows the elapsed time indicating meter to record the cumulative time during which the device is actually performing work.

19 Claims, 1 Drawing Figure

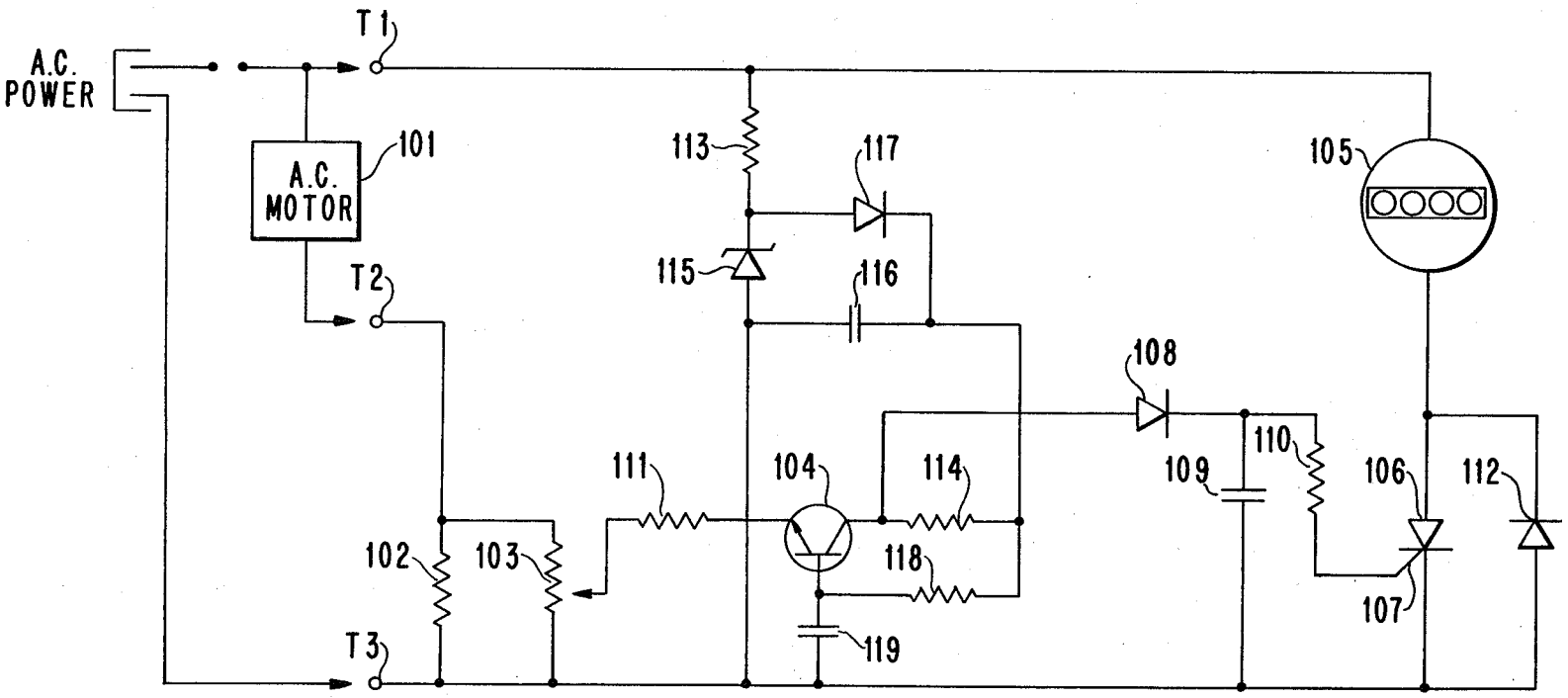
A.C. POWER
T 1
101
A.C. MOTOR
T 2
T 3
102
103
111
113
115
117
116
104
114
118
119
108
109
110
105
106
107
112

OPERATIONAL TIMER CIRCUIT FOR MONITORING A MOTOR UNDER LOAD

BACKGROUND OF THE INVENTION

1. Technical Field

The present invention is directed to an operational timer circuit for monitoring the amount of time during which a device is in use. More particularly, the present invention is directed to an operational timer circuit for monitoring the time during which the device is under load.

2. Background Information

Elapsed time indicating meters, meters recording the time during which a device is operating, are well known in the art.

In U.S. Pat. No. 3,321,489 issued to Mackey et al., herein incorporated by reference, an elapsed processing time meter is disclosed for use with an electronic digital computer to record the computer time utilized to perform actual computing operations for billing and preventive maintenance purposes. The time meter records the time during which a digital computer is performing computations, defined as the time during which the computer's memory unit is in operation. A pick-up device is located adjacent to the memory unit to pick up radiant electrical signals when the memory unit is in operation. The output from the pick-up device is amplified by a first amplifier and the output from the first amplifier is amplified by a second amplifier whose output is used to trigger a power relay. The output of the second amplifier is coupled to the coil of the power relay, and when this coil is energized; the power relay actuates a switch, allowing power to flow to a clock, thereby recording the time during which the computer's memory unit is in use. The circuitry also includes a power supply for generating the proper positive and negative voltages for the first and second amplifiers and the power relay. The power supply circuitry includes a fused power transformer, rectifying diode, and filtering resistors and capacitors.

Although adequate for its purpose, systems such as Mackey are deficient for several reasons. As more than one amplifier stage is needed, the circuitry is more complex and the additional components inherently reduce circuit reliability. Additionally the requirement of a separate power supply adds to a degradation of circuit reliability. Further, the requirement of a power transformer increases the space requirement of the circuit. The power relay further adds to overall circuit size, in addition to relatively large power requirements required by a power relay.

In U.S. Pat. No. 3,258,908 issued to Fischer, herein incorporated by reference, an elapsed time indicating meter is shown for use with tape cartridge recorders for reading out the total unconsumed time available for recording on a given tape. The circuit in Fischer is connected to the control output leads from a recorder, and the voltage therefrom is rectified and filtered via a clipper circuit, the output of which is coupled across the base and collector of a transistor for amplification. A coil is connected to the emitter of the transistor for activating a switch when the coil is energized. The switch turns the timer motor on, thereby tracking the remaining recording time. Also included in the tape cartridge timer circuit is a transformer, rectifier and filter arrangement for supplying power to the coil and amplifier. Although the Fischer circuit offers improved reliability from the above Mackey circuit by requiring only one amplifier stage, the problems associated with a power relay circuit and a power supply with a transformer are also inherent in Fischer.

Elapsed time indicating meters also find utility in recording the cumulative running time of electric ignition engines, examples of which are shown in U.S. Pat. No. 3,299,627 issued to Hart et al. and U.S. Pat. No. 3,948,039 issued to Leveraus, both of which are herein incorporated by reference.

The Hart circuit is connected to the positive and negative potentials of the battery ignition system, and the circuit is switchable by the engine's ignition switch. Connected across the battery terminals is an inductive coil in series with a transistor. The coil cooperates with a magnetic circuit to form the input for an electrical pulse counter comprising a pawl-ratchet mechanism. The pawl is connected to the armature of the coil and the ratchet is connected to a series of counting wheels by suitable gearing. Electrical pulses delivered to the coil index the ratchet and associated counting wheels at the desired rate. The electrical pulses are derived from a circuit both connected across the battery terminals and operatively coupled to the base of the transistor. The pulse delivery circuit includes an RC timer network wherein the voltage across the capacitor, upon reaching a predetermined threshold value, triggers a field-effect transistor, the output of which provides sufficient base current to the transistor in series with the coil to turn the transistor on, thereby energizing the coil and applying the requisite indexing pulse to the pulse counter.

The major design flow of circuits such as Hart et al. is that the circuit is not accident-proof. The ignition switch may be turned on accidentally and may remain on for several hours. A considerable lapse of time may transpire before it is noticed that the switch is on. Under these circumstances, it is rarely possible to know the actual running time of the vehicle since the time recorded on the meter is in error.

One possible solution to this problem is shown by Leveraus, wherein the timer circuit is operated by a signal which operates off of the tachometer. The Leveraus circuit employs a monolithic Darlington transistor in series with a solenoid to activate the time indicating meter. When the vehicle's tachometer is operating, a pulse signal from the alternator is both rectified and filtered and used to turn on a field-effect transistor, the output of which causes the Darlington transistor to turn on, thereby energizing the armature of the solenoid to send power to the time indicating meter.

All of the above circuits utilize a coil (solenoid) to switchably control the elapsed time indicating meter. As discussed above, the coils are both bulky and have a relatively large power requirement. Accordingly, although the cumulative time during which a device is operating is recorded, the load on the system is increased. This load not only shortens the life of the battery, but may further render the subsequent operation of the engine nonfunctional should the battery voltage drop below its requisite threshold. Furthermore, given the tendency towards decreasing the size of circuitry, the volume required by the solenoid and/or the power transformer may be unacceptable in many circumstances.

In addition to the deficiencies in the prior art relating to circuit size, cost, power requirements and reliability, as discussed above, the prior art timer circuits are also deficient in that they measure only the time a device is operating generally (merely turned on), as opposed to measuring the time during which a device is operating under load. The latter requirement finds particular utility in applications where periodic preventive maintenance is determined based upon load time usage, or where the load time usage is indicative of actual hours performing a service, such as vacuuming a carpet by maintenance personnel.

SUMMARY OF THE INVENTION

Accordingly, it is an object of the present invention to provide a circuit for operating an elapsed time indicating meter which overcomes the deficiencies in the prior art by utilizing a single stage amplifier and a compact switch for supplying power to the meter.

Additionally, it is an object of the present invention to provide a circuit for detecting the time during which a device is operating either generally or under load conditions.

Furthermore, it is an object of the present invention to provide a power supply for the elapsed time indicating meter circuit which does not require components having large volume, thereby reducing overall circuit size.

In accordance with the above objects, the circuit of the present invention includes three input terminals wherein a switchable a.c. power source is connectable to the first and third input terminals and the a.c. device whose cumulative time of operation is to be recorded is connected to the first and second input terminals.

The circuit comprises an elapsed time indicating meter and a silicon-controlled rectifier, used to supply power to the meter, connected in series across the circuit's first and third terminals. Additionally, the circuit includes a small resistor connected between the second and third input terminals, that is, connected in series with the a.c. device. This small resistor receives the current through the a.c. device and the voltage across the small resistor is indicative of the operational state of the a.c. device. A variable potentiometer is connected full scale across the small resistor and the variable voltage is amplified by a common-base transistor. This amplified voltage is both rectified and filtered, serving as the SCR's gate terminal input for triggering the SCR.

The potentiometer is adjustable to allow the SCR to trigger in either one of two conditions. The potentiometer can be adjusted so that the SCR triggers at all times during which the motor is turned on, or the potentiometer can be adjusted so that the SCR turns on only when the device, such as a motor, is operated under load. The latter condition allows the elapsed time indicating meter to record the cumulative time during which the device is actually performing work.

The power supply for the single stage amplifier comprises a resistor and a zener diode connected in series across the circuit's first and third terminals. This voltage is rectified and filtered to provide substantially constant and uni-polarity power to the amplifier.

BRIEF DESCRIPTION OF THE DRAWINGS

The FIGURE shows a circuit diagram of the preferred embodiment of the circuit for operating an elapsed time indicating meter.

DESCRIPTION OF THE PREFERRED EMBODIMENT

Turning now to the FIGURE, the schematic diagram of the preferred embodiment of the operational timer circuit of the present invention is illustrated, and includes terminals T1, T2 and T3. Device 101, whose cumulative time of operation the timer circuit is to record, is operatively connected between the circuit's input terminals T1 and T2. In the preferred embodiment, device 101 is an a.c. motor which draws current at a first predetermined level when the motor is on and draws current at a second predetermined level when the motor is under load. A switchable a.c. power source is connectable to the circuit's input terminals T1 and T3.

The operational timer circuit includes resistor 102 connected between input terminals T2 and T3 for detecting the current drawn by device 101. In the preferred embodiment, resistor 102 has a small resistance value to minimize the voltage drop across the resistor.

Potentiometer 103 is connected full scale across resistor 102, and the full scale voltage reading across potentiometer 103 is identical to the voltage reading across resistor 102. The potentiometric terminal of potentiometer 103 adjustably controls the voltage to common base transistor 104.

Elapsed time indicating meter 105 is connected in series with silicon controlled rectifier (SCR) 106, the meter and SCR being coupled across the circuit's input terminals T1 and T3. As is well known in the art, the SCR operates as a short circuit when ever current at gate terminal 107 is positive. Absent a positive current value at gate terminal 107, the SCR operates as an open circuit.

The voltage across potentiometer 103 is adjustable to apply a range of voltages to common base transistor 104 such that a predetermined voltage of the amplified voltage across the potentiometer will trigger the SCR. Thus, potentiometer 103 is adjustable to set the threshold level which causes the SCR to conduct, thereby permitting elapsed time indicating meter 105 to record the cumulative time during which device 101 is operating at a specified condition. The specified condition can either be at all times during which device 101 is operating generally or, in the preferred embodiment, at all times during which device 101 is operating under load conditions. Load conditions, therefore, is detected by the circuit as the increased current drawn by device 101 as seen by resistor 102.

The output of common base transistor 104 is rectified by diode 108 and filtered by capacitor 109. In the preferred embodiment, resistor 110 is included in order to limit the current drawn from the collector of the common base transistor when the SCR turns on. Likewise, resistor 111 is included in the preferred embodiment in order to limit the current in the line between the potentiometric terminal of potentiometer 103 and the emitter of common base transistor 104.

Diode 112 is connected in parallel with the SCR to provide bias current for the elapsed time indicating meter at all times except when the SCR is conducting.

Biasing for the common base transistor is obtained by resistors 113 and 114, and the biasing voltage is kept relatively constant and of one polarity by Zener diode 115, capacitor 116 and diode 117. The common base transistor base bias is obtained by resistor 118 and capacitor 119.

Although other circuit component values will be readily obvious to those skilled in the art, the preferred embodiment of the operational timer circuit shown in the Figure comprises component values as follows:

Resistors 102, 103, 110, 111, 113, 114 and 118 have resistances values of (in Ohms) of 0.01, 100 (full scale), 20k, 220, 47k, 10k and 1 M, respectively.

Capacitors 109, 116 and 119 have values (in uf) of 3.3, 47 and 4.7, respectively.

Diodes 108, 112, 115 and 117 are part numbers 1N914, 1N4006, 6.8 v Zener and 1N914, respectively.

Common base transistor 104 is part number 2N2222 and, SCR 106 has a 0.84 400 PIV sensitive gate.

Elapsed time indicating meter 105 can be any device which displays time in either hours, minutes, seconds or any combination thereof, and can either be illuminating or nonilluminating. In the preferred embodiment, meter 105 displays illuminated time in hours and minutes, such as part number T4A52B mini hour meter 4020 manufactured by *EHM COMPANY.*

Although illustrative embodiments of the present invention have been described in detail with reference to the accompanying drawing, it is to be understood that the invention is not limited to that precise embodiment. Various changes or modifications may be effected therein by one skilled in the art without departing from the scope or spirit of the invention.

For example, although the preferred embodiment is shown for use with devices operating at standard United States and Canadian a.c. power sources, circuit component modifications will be readily obvious to those skilled in the art for applications with devices operating from different a.c. sources voltages and/or frequencies.

What we claim as our invention is:

1. A circuit for detecting and recording the cumulative time during which an a.c. motor is operating under load, the motor current being at a first predetermined level when the motor is on and at a second predetermined level when the motor is under load, said timer circuit comprising first, second and third terminals, the motor connectable between said first and second terminals, switchable alternating current power connectable between said first and third terminals, said timer circuit further comprising:

a silicon controlled rectifier (SCR) having anode, cathode and gate terminals; said cathode terminal connected to said timer circuit's third terminal;

an elapsed time indicator to record the time during which the motor is operating under load, said indicator having a first power connection connected to said timer circui's first terminal and a second power connection connected to said SCR's anode terminal;

a motor current detection circuit connected between said timer circuit's second and third terminals for receiving the current through the motor and outputting voltage proportional to the current through the motor;

an amplifier having first, second and third terminals, said first and second terminals operatively connected to the output of said motor current detection circuit and said timer circuit's third terminal, respectively, to receive and amplify the voltage from said motor current detection circuit and output said amplified voltage at said amplifier's third terminal;

amplifier biasing circuit whose first and second input terminals are operatively connected to said timer circuit's first and third terminals, respectively, and whose first and second output terminals are operatively connected between said amplifier's third and second terminals, respectively, to provide substantially constant biasing voltage to said amplifier;

a rectifier operatively connected between said amplifier's third terminal and said SCR's gate terminal to rectify said amplified voltage, wherein said rectified voltage causes said SCR to conduct when said motor current is at least at the second predetermined value; and elapsed time indicator biasing circuit connected across said SCR's anode and cathode to provide bias current to said elapsed time indicator when said SCR is not conducting.

2. The timer circuit of claim 1 wherein said amplifier comprises an n-p-n transistor having emitter, base and collector terminals being said amplifier's first, second and third terminals, respectively, and wherein said amplifier biasing circuit comprises:

a zener diode having an anode and a cathode, said anode connected to said timer circuit's third terminal;

a first diode having an anode and a cathode, said first diode's anode connected to said zener diode's cathode;

a first resistor connected between said zener diode's cathode and said timer circuit's first terminal;

a first capacitor connected between said zener diode's anode and said first diode's cathode;

a second resistor connected between said first diode's cathode and said transistor's collector terminal.

a third resistor connected between said first diode's cathode and said transistor's base terminal; and a second capacitor connected between said transistor's base terminal and said timer circuit's third terminal.

3. The timer circuit of claim 2 wherein said motor current detection circuit comprises:

a fourth resistor connected between said timer circuit's second and third terminals;

a variable resistor connected full scale across said fourth resistor and the potentiometric terminal operatively connected to said amplifier's emitter terminal.

4. The timer circuit of claim 3 wherein said motor current detection circuit further comprises:

a fifth resistor connected between said variable resistor's potentiometric terminal and said amplifier's emitter terminal.

5. The timer circuit of claim 3 wherein said rectifier comprises:

a second diode having its anode connected to said transistor's collector terminal; and a fifth resistor connected between said second diode's cathode and said SCR's gate terminal.

6. The timer circuit of claim 5 further comprising a third capacitor connected between said second diode's cathode and said timer circuit's third terminal to filter the rectified voltage.

7. The timer circuit of claim 1 wherein said elapsed time indicator biasing circuit comprises a diode having its cathode and anode connected across said SCR's anode and cathode, respectively.

8. The timer circuit of claim 1 wherein said motor current detection circuit comprises:

a fourth resistor connected between said timer circuit's second and third terminals;

a variable resistor connected full scale across said fourth resistor and the potentiometric terminal operatively connected to said amplifier's emitter terminal.

9. The timer circuit of claim 8 wherein said motor current detection circuit further comprises:

a fifth resistor connected between said variable resistor's potentiometric terminal and said amplifier's emitter terminal.

10. The timer circuit of claim 1 wherein said rectifier comprises:

a second diode having its anode connected to said amplifier's third terminal; and a fifth resistor connected between said second diode's cathode and said SCR's gate terminal.

11. The timer circuit of claim 10 further comprising a third capacitor connected between said second diode's cathode and said timer circuit's third terminal to filter the rectified voltage.

12. A circuit for detecting and recording the cumulative time during which an a.c. motor is operating under load, the motor current being at a first predetermined level when the motor is on and at a second predetermined level when the motor is on and at a second predetermined level when the motor is operating under load, said timer circuit comprising first, second, third and fourth terminals, the motor connectable between said timer circuit's first and second terminals, a switchable alternating current power source connectable between said timer circuit's first and third terminals, a device for recording the cumulative time during which the motor is operating under load, the recording device connectable between said timer circuit's first and fourth terminals, said timer circuit further comprising:

a silicon controlled rectifier (SCR) whose anode and cathode are connected to said timer circuit's fourth and third terminals, respectively;

recording device biasing circuit connected between said timer circuit's fourth and third terminals to provide bias current to the recording device;

motor current detection circuit whose two input terminals are connected between said timer circuit's second and third terminals to receive the current through the motor current and output a voltage proportional to the motor current.

a common base amplifier whose emitter is connected to the output of said motor current detection circuit and whose base is operatively connected to said timer circuit's third terminal to amplify said voltage proportional to the motor current;

amplifier voltage biasing circuit whose two inputs are connected to said timer circuit's first and third terminals and whose output is operatively connected to said amplifier's collector, said voltage biasing circuit to provide substantially constant voltage of one polarity to said amplifier;

amplifier base biasing circuit operatively connected between said amplifier's collector and base; and a rectifier circuit operatively connected between said amplifier's collector and said SCR's gate terminal to rectify said amplified voltage, wherein said rectified voltage causes said SCR to conduct when said motor current is at least at the second predetermined level.

13. The circuit of claim 12 wherein said rectifier circuit comprises:

a diode whose anode is connected to said amplifier's collector;

a capacitor connected between said diode's cathode and said timer circuit's third terminal to filter the rectified voltage; and a resistor connected between said diode's cathode and said SCR's gate terminal to limit the current drawn from the collector of said amplifier when said SCR is conducting.

14. The circuit of claim 12 wherein said motor current detection circuit comprises:

a first resistor connected between said timer circuit's second and third terminals; and a variable resistor connected full scale across said first resistor with the potentiometric terminal operatively connected to said amplifier's emitter.

15. The circuit of claim 14 wherein said motor current detection circuit further comprises a second resistor connected between said potentiometric terminal and said amplifier's emitter to limit the current therethrough.

16. The circuit of claim 12 wherein said amplifier voltage biasing circuit comprises:

a zener diode whose anode is connected to said timer circuit's third terminal;

a first resistor connected between said timer circuit's first terminal and said zener diode's cathode;

a diode whose anode is connected to said zener diode's cathode, said diode's cathode operatively connected to said amplifier's collector; and a capacitor connected between said diode's cathode and said zener diode's anode.

17. The circuit of claim 16 wherein said amplifier voltage biasing circuit further comprises a second resistor connected between said diode's cathode and said amplifier's collector.

18. The circuit of claim 16 wherein said amplifier base biasing circuit comprises:

a second resistor connected between said diode's cathode and said amplifier's base; and a second capacitor connector between said amplifier's base and said timer circuit's third terminal.

19. The circuit of claim 12 wherein said recording device biasing circuit comprises a diode whose anode and cathode are connected to said timer circuit's third and fourth terminals, respectively.

* * * * *